US008151610B2

(12) United States Patent
Fujihara

(10) Patent No.: US 8,151,610 B2
(45) Date of Patent: Apr. 10, 2012

(54) DOOR LATCH DEVICE FOR A MOTOR VEHICLE

(75) Inventor: Yoshihiko Fujihara, Minamiarupusu (JP)

(73) Assignee: Mitsui Kinzoku Act Corporation (JP)

( * ) Notice: Subject to any disclaimer, the term of this patent is extended or adjusted under 35 U.S.C. 154(b) by 0 days.

(21) Appl. No.: 12/678,848

(22) PCT Filed: Jun. 10, 2008

(86) PCT No.: PCT/JP2008/060598

§ 371 (c)(1),
(2), (4) Date: Mar. 18, 2010

(87) PCT Pub. No.: WO2009/037904

PCT Pub. Date: Mar. 26, 2009

(65) Prior Publication Data

US 2010/0212374 A1 Aug. 26, 2010

(30) Foreign Application Priority Data

Sep. 19, 2007 (JP) ..... 2007-242812

(51) Int. Cl.
*E05B 49/00* (2006.01)

(52) U.S. Cl. ..... 70/278.7; 70/237; 70/279.1; 292/216; 292/201; 292/DIG. 23

(58) Field of Classification Search ..... 70/278.7, 70/279.1; 292/216, 201, DIG. 23
See application file for complete search history.

(56) References Cited

U.S. PATENT DOCUMENTS

| | | | | |
|---|---|---|---|---|
| 6,019,402 | A * | 2/2000 | Arabia et al. | 292/216 |
| 6,053,543 | A * | 4/2000 | Arabia et al. | 292/201 |
| 6,102,453 | A * | 8/2000 | Cetnar | 292/201 |
| 6,279,361 | B1 * | 8/2001 | Baukholt et al. | 70/279.1 |
| 6,511,106 | B2 * | 1/2003 | Perkins et al. | 292/216 |

(Continued)

FOREIGN PATENT DOCUMENTS

| | | |
|---|---|---|
| JP | 2001-509222 A | 7/2001 |
| JP | 2003-184396 A | 7/2003 |

(Continued)

OTHER PUBLICATIONS

International Search Report dated Jul. 22, 2008, issued in corresponding international application No. PCT/JP2008/060598.

*Primary Examiner* — Lloyd Gall
*Assistant Examiner* — David E Sosnowski
(74) *Attorney, Agent, or Firm* — Ostrolenk Faber LLP

(57) ABSTRACT

An operation mechanism section has a key lever that follows operation of a key cylinder, a lock lever that can move to an unlock position where operation of an operation handle is enabled and to a lock position where it is disabled, linkage levers that, when the lock lever is at the unlock or lock position, follows operation of the operation handle to make a door openable or not openable, and a motor that can move the lock lever to the unlock or lock position. The lock lever is formed by integrating together a gear section, a key operation input section, and an operation transmission section. The gear section is supported so as to be pivotable about a pivot shaft to the unlock and lock positions and directly meshing with a worm gear installed on the rotating shaft of the motor. The key operation input section is directly connected to the key lever. The operation transmission section is directly connected to the linkage lever.

4 Claims, 14 Drawing Sheets

U.S. PATENT DOCUMENTS

| | | | | |
|---|---|---|---|---|
| 6,733,052 | B2 * | 5/2004 | Perkins et al. | 292/201 |
| 7,827,836 | B2 * | 11/2010 | Cetnar | 70/278.7 |
| 2008/0203737 | A1 * | 8/2008 | Tomaszewski et al. | 292/216 |
| 2010/0013246 | A1 * | 1/2010 | Tomaszewski et al. | 292/216 |

FOREIGN PATENT DOCUMENTS

| | | | |
|---|---|---|---|
| JP | 2005-307573 | A | 11/2005 |
| JP | 3736267 | B2 | 11/2005 |
| WO | WO 98/33998 | | 8/1998 |

* cited by examiner

DOOR LATCH DEVICE FOR A MOTOR VEHICLE

CROSS REFERENCE TO RELATED APPLICATIONS

The present application is a 35 U.S.C.§371 National Phase conversion of PCT/JP2008/060598, filed Jun. 10, 2008, which claims benefit of Japanese Application No. 2007-242812, filed Sep. 19, 2007, the disclosure of which is incorporated herein by reference. The PCT International Application was published in the Japanese language.

TECHNICAL FIELD

The present invention relates to a door latch device for a motor vehicle comprising an engagement section and an operating section for operating the engagement section.

BACKGROUND OF THE INVENTION

A door latch device for a motor vehicle comprises an engagement section which engages with a striker on the car body and an operating section for controlling the engagement section. The operating section comprises a locking lever driven by a motor with a remote control switch and a key cylinder outside a door; an interconnecting lever connected to the locking lever and driven by a handle on the door; and other levers. The locking lever and the interconnecting lever are movable between an unlocking position for opening the door with the handle and a locking position in which the door cannot be opened with the handle as disclosed in Japanese Patent No. 3736267.

However, in the conventional door latch device for a motor vehicle, the worm wheel for transmitting motor power to the locking lever is disposed to align with the locking lever along its thickness. The operating section becomes thicker. With increase in the number of other parts, there are a lot of parts for coupling each element to each other at an operating-force transmitting path between the motor and the interconnecting lever, thereby making its structure more complicated.

In view of the disadvantages, it is an object of the invention to provide a door latch device for a motor vehicle in which an operating section is made smaller, the number of connections at operating force transmitting path between a motor and an interconnecting lever being as small as possible to simplify the structure of the operating section.

BEST MODE FOR CARRYING OUT THE INVENTION

Figure 1:
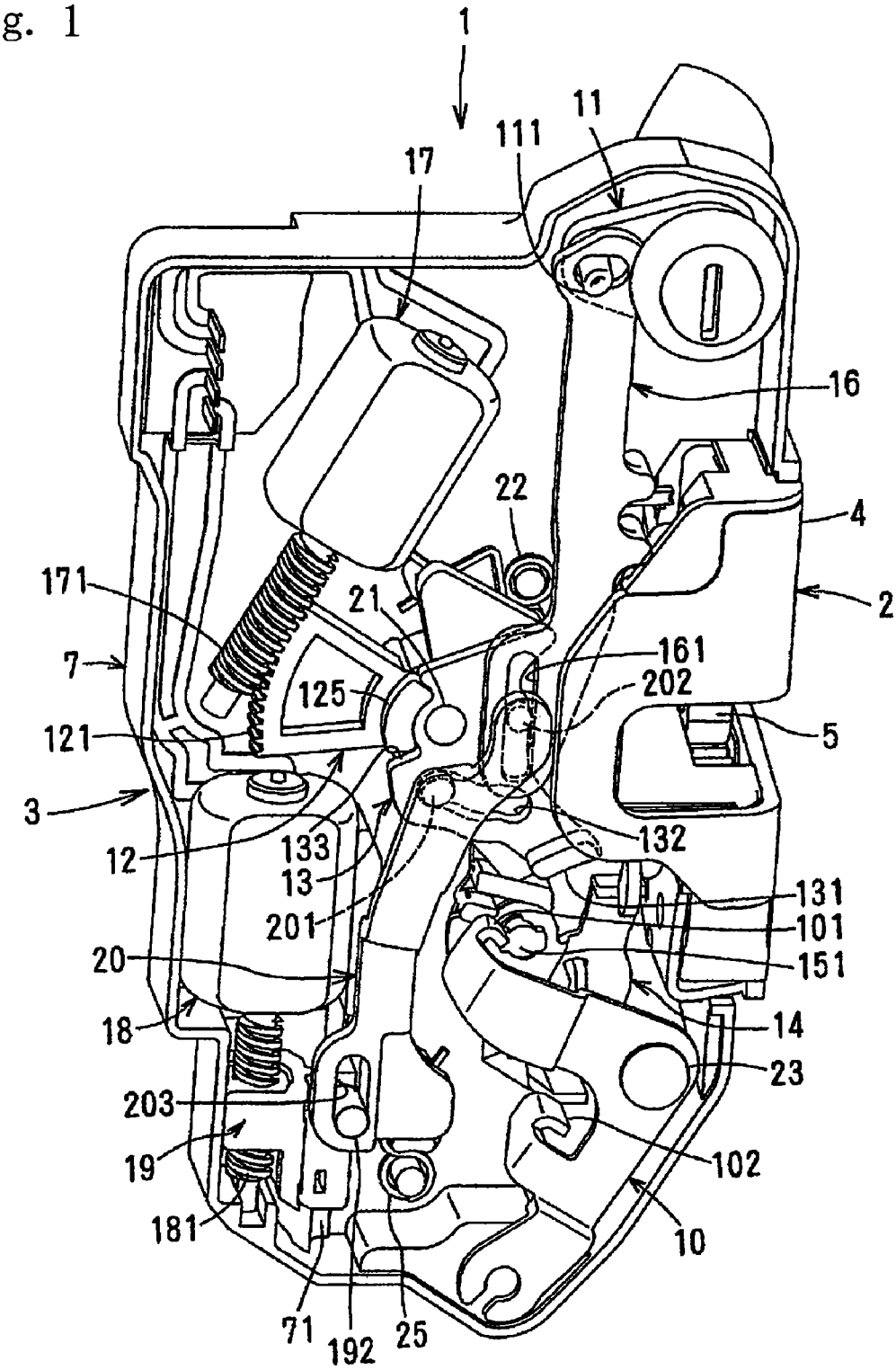
FIG. 1 is a perspective view of a door latch device according to the present invention seen from the inside of a car.

A door latch device 1 is disposed on the inside of a front door (hereinafter referred to "door") at the rear end and comprises an engagement section 2 for holding the door in a closed position and an operating section 3 for operating the engagement section 2.

The door latch device 1 is provided on the inside of the door, is used in a door having no manually locking knob and is in an unlocking state, a locked state and a double-locking state. In the unlocking state, the door can be opened with either an outer handle (not shown) on the outside of the door or an inner handle (not shown) on the inside of the door. In the locked state, the door cannot be opened with the outer handle, but can be opened with the inner handle by double actions for changing the locked state to the unlocking state first and opening the door second. In the double locking state, the door cannot be opened by the outer or inner handle even if the double action of the inner handle is invalidated.

The engagement section 2 comprises a body 4 fixed to the rear end of the inside of the door with a plurality of bolts (not shown); a latch 5 pivotally coupled in the body 4 with a pivot shaft 51 to engage with a striker (not shown) fixed to a vehicle body; a ratchet (not shown) pivotally coupled in the body 4 with a pivot shaft 61; and an opening lever 6 that can turn together on the pivot shaft 61 with the ratchet. When the door is closed, the striker engages with the latch 5, and the ratchet engages with the latch 5 so that the latch 5 does not turn. With the outer or inner handle, the opening lever 6 turns in a releasing direction or in a counterclockwise direction as shown by an arrow in FIG. 2, so that the ratchet disengages from the latch 5 to enable the door to open. The structure of the engagement section 2 does not directly relate to the present invention, and detailed description thereof is omitted.

The front face of the body 4 is covered and fixed with a synthetic resin cover 7. In the cover 7, the operating section 3 is disposed. The operating section 3 comprises the outer lever 8 connected to a rod of the outer handle via an operating force transmitting member (not shown); an inner lever 10 connected to the inner handle via a cable 9 for transmitting an operating force; first and second key levers 11,16 that follow operation of a key cylinder (not shown) outside the door; a locking lever 12; a subsidiary locking lever 13 for carrying out double-locking; first and second interconnecting levers 14,15 following the outer lever 8; a locking motor 17; a sliding block 19 following a double-locking motor 18; and a sliding lever 20 driven by the double-locking motor 18.

Figure 2:
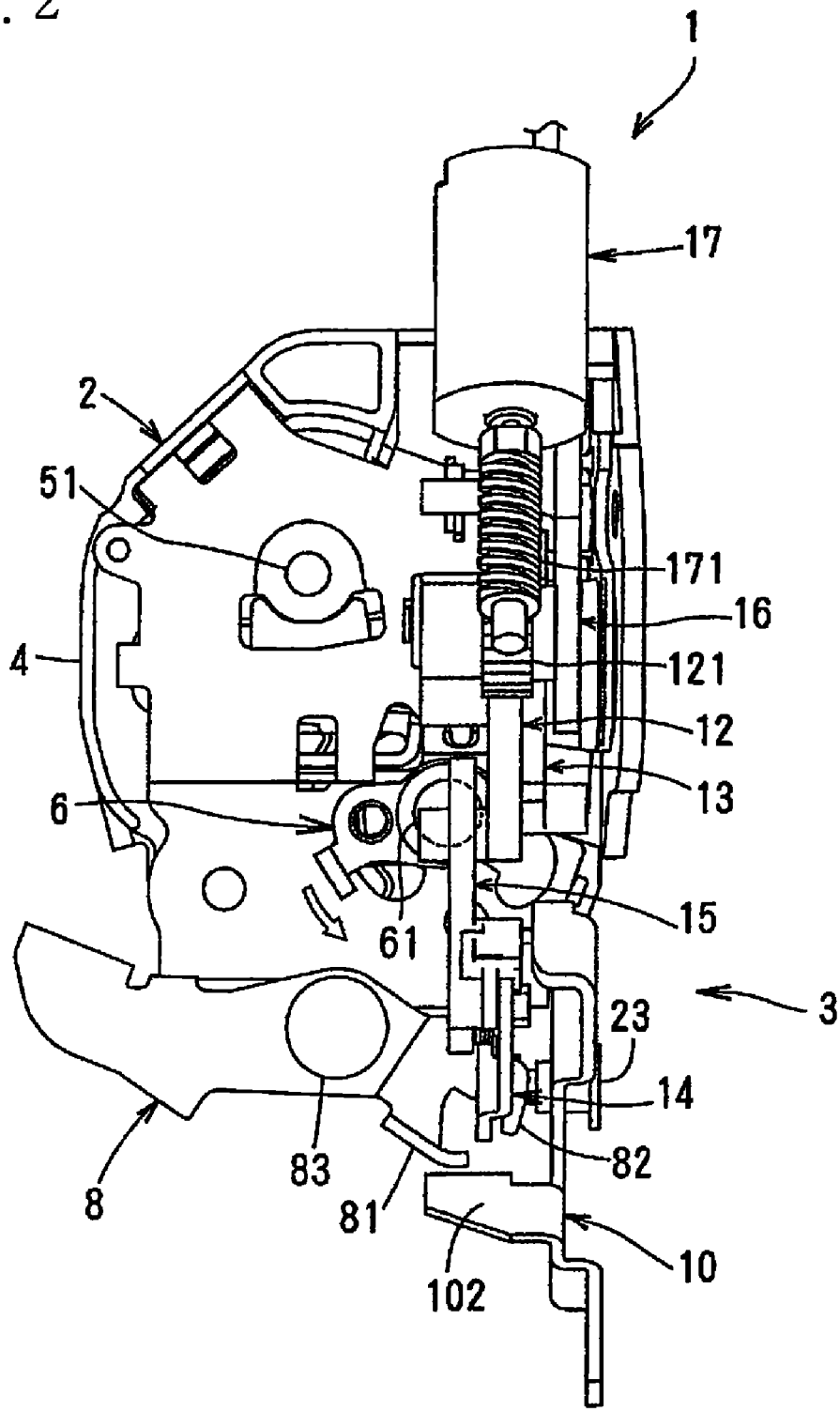
FIG. 2 is a schematic side view of the door latch device.

In FIG. 2, the outer lever 8 is pivotally mounted on a pivot shaft 83 at the lower part of the cover 7 and turns from a standby position against a force of a spring (not shown) in a releasing direction or a counterclockwise direction according to door-opening operation of the outer handle. In FIG. 2, the cover 7 is omitted for simplification of the drawings. To the right end 82 of the outer lever 8, the first interconnecting lever 14 is coupled to turn To the first interconnecting lever 14, the lower part of the second interconnecting lever 15 is coupled to turn with a connecting shaft.

Figure 4:
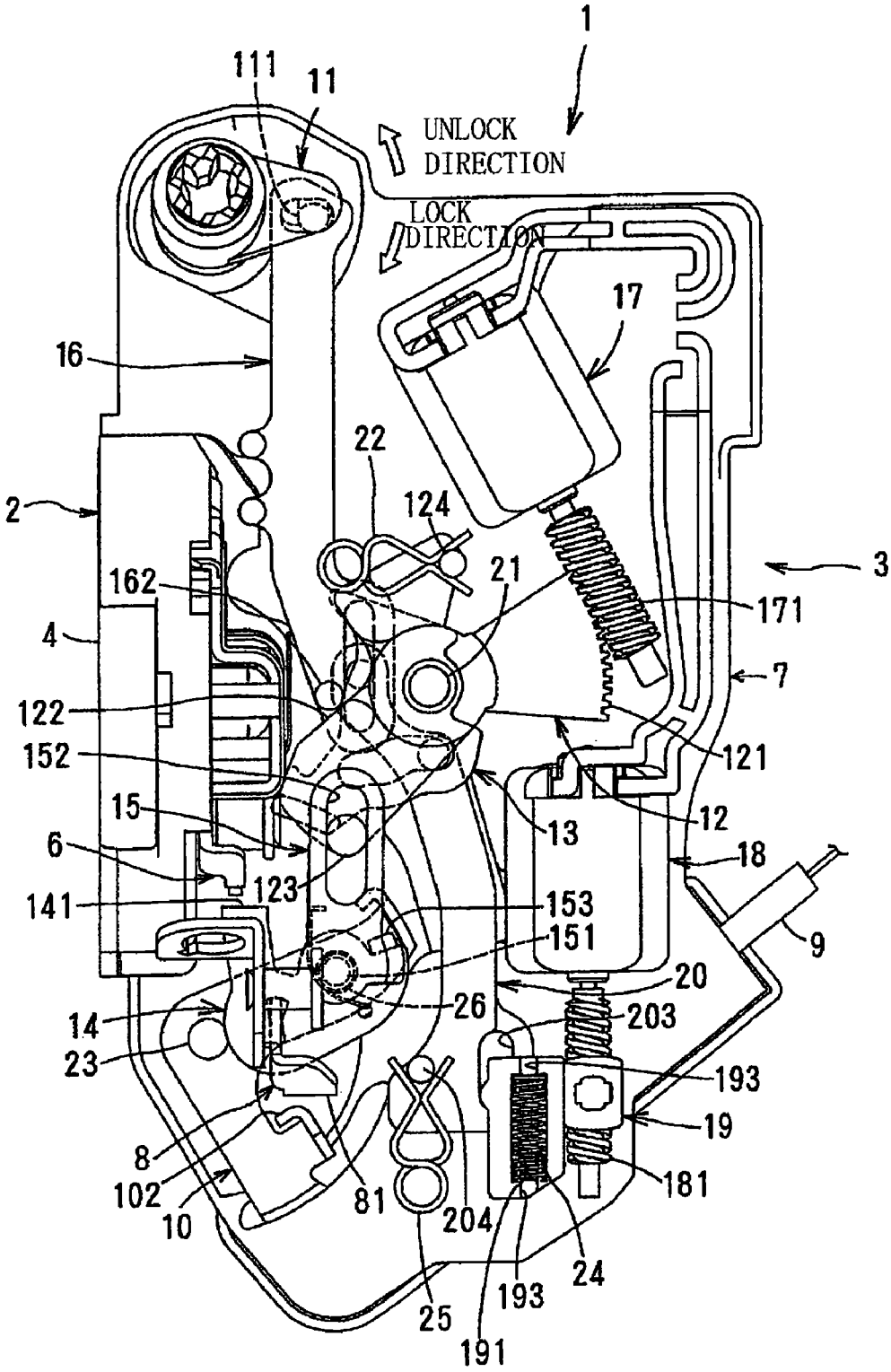
FIG. 4 is a rear view of the unlocked door latch device.

The first key lever 11 is pivotally coupled to the upper part of the cover 7 and turns from a neutral position such as a position in FIG. 4 in an unlocking direction or a counterclockwise direction in FIG. 4 and in a locking direction or a clockwise direction.

The second key lever 16 is coupled at the upper end to the first key lever 11 with a connecting shaft 111, moves up from the neutral position in FIG. 4, following rotation of the first key lever 11 in an unlocking direction and moves down from the neutral position, following rotation in a locking direction. At the lower part of the second key lever 16, there are formed an elongate opening 161 in which a sliding lever 20 engages with a play, and a projection 162 which engages with the locking lever 12 with play.

Figure 13:
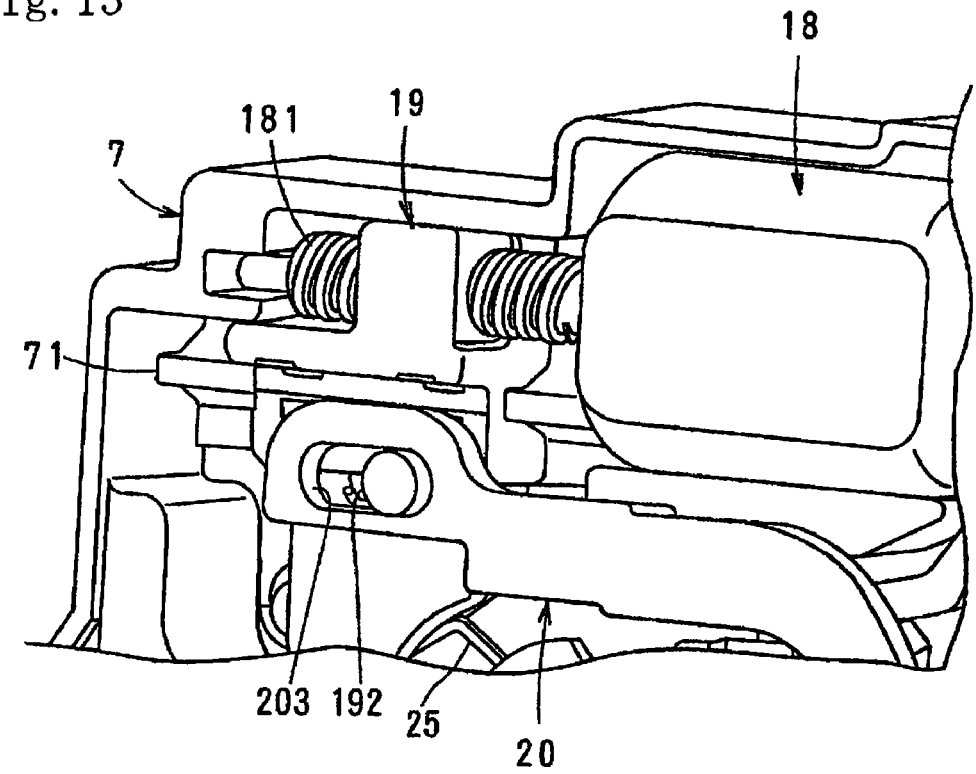
FIG. 13 is a perspective view for illustrating a sliding block and a slide lever.
Figure 14:
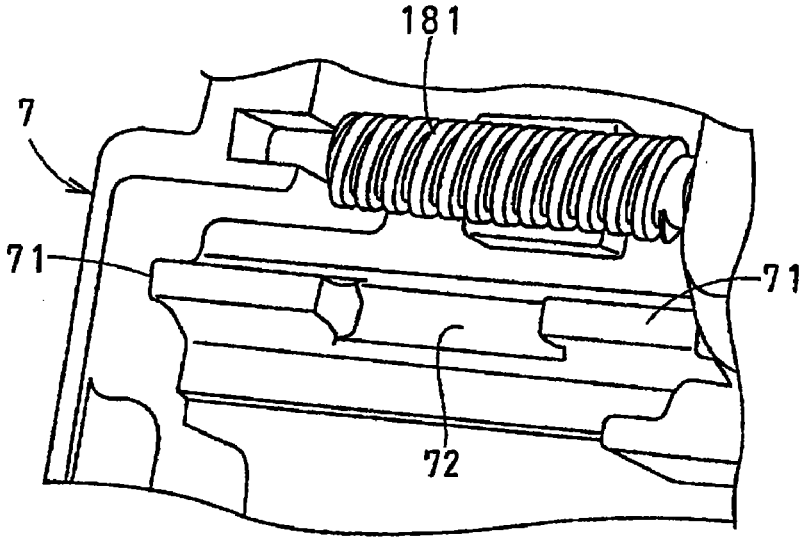
FIG. 14 is a perspective view of a cover when the sliding block and the slide lever are removed.
Figure 15:
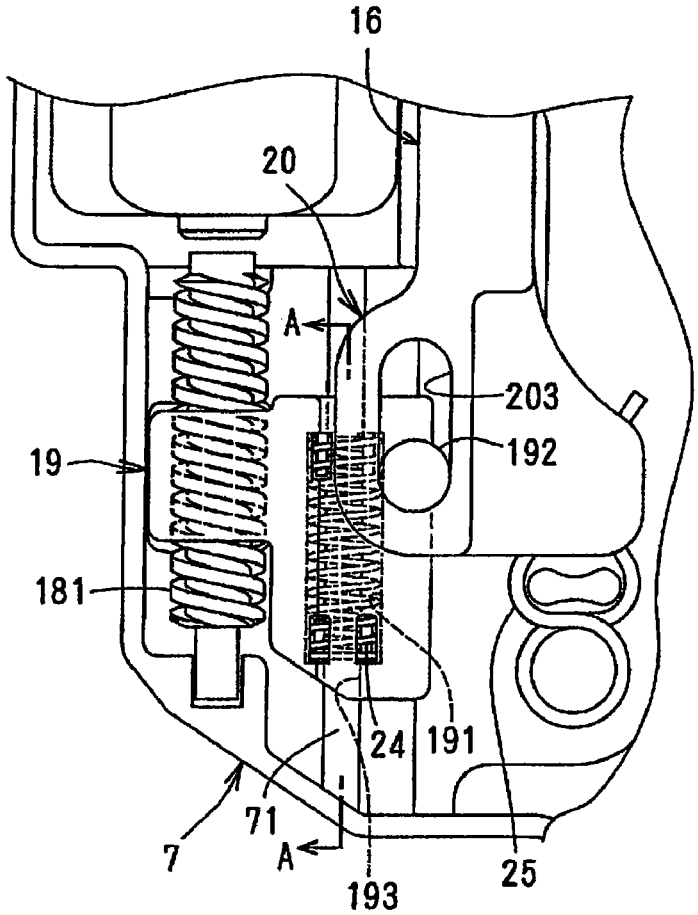
FIG. 15 is a front view for illustrating the sliding block.
Figure 16:
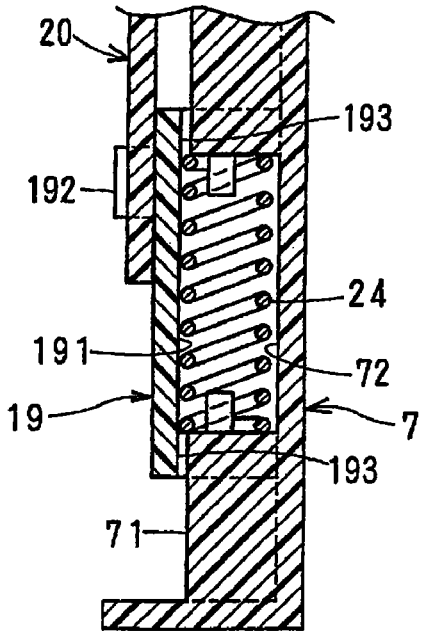
FIG. 16 is a sectional view taken along the line A-A in FIG. 15.
Figure 17:
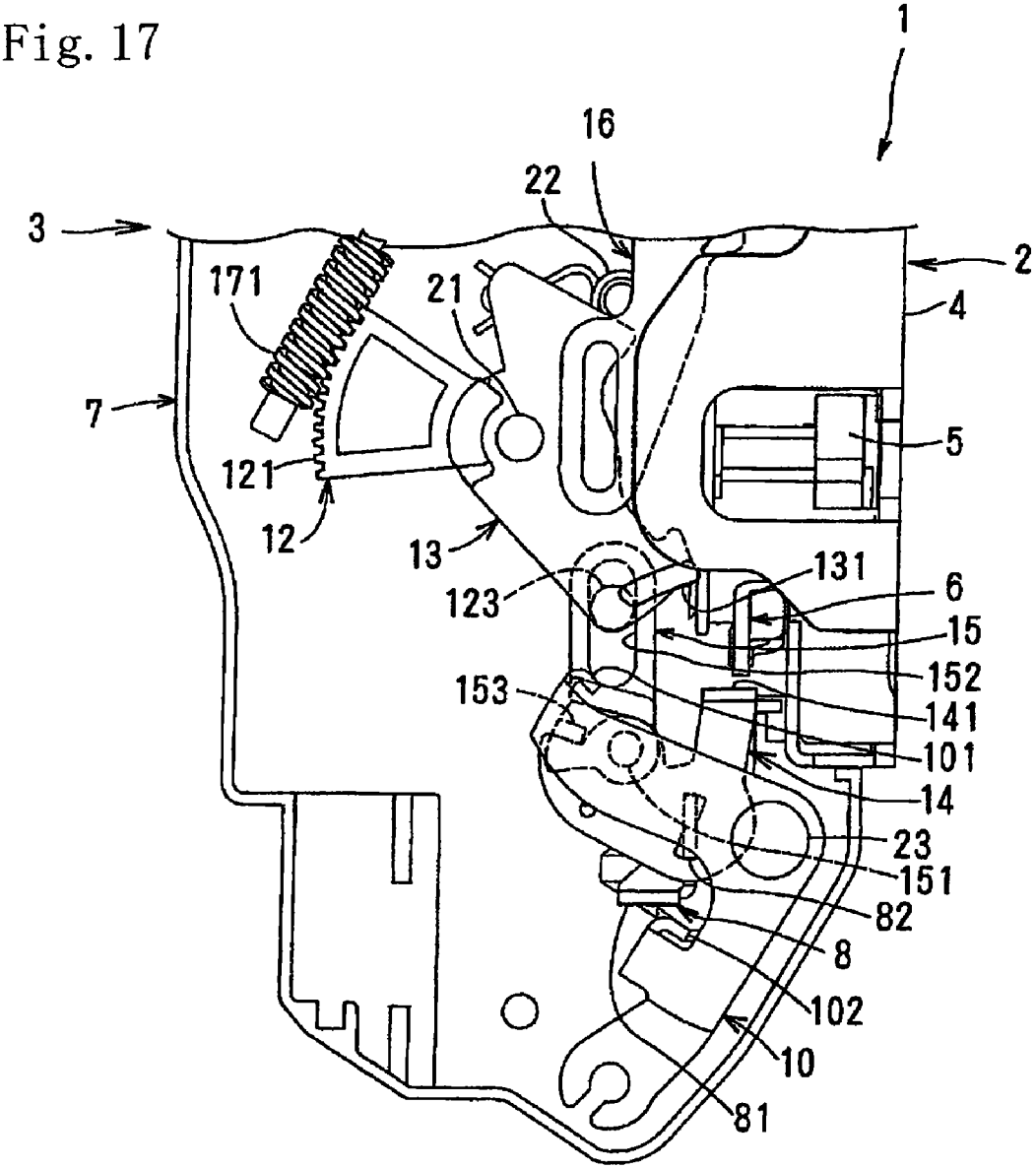
FIG. 17 is a front view of another embodiment of a door latch device according to the present invention.

In FIGS. 13 and 14, a sliding block 19 is slidably supported on a guide portion 71 of the cover 7. A worm gear 181 on a rotation shaft of the double-locking motor 18 is through the sliding block 19. On the surface of the sliding block 19 opposing the cover 7, there are formed a space 191 and a guide groove 193 which is in sliding contact with a guide portion 71.

In the space 191 of a sliding block 19, a coil spring 24 is compressed in the space 191 of the sliding block 19 and held in a groove 72 in the middle of the guide portion 71 to urge the sliding block 19 toward a neutral position in FIGS. 3 to 6. The sliding block 19 meshes with the worm gear 181 reversibly.

The double-locking motor 18 rotates in a locking or unlocking direction with a remote control switch (not shown).

When the double-locking motor 18 rotates in the locking direction, the sliding block 19 moves down from the neutral position to the double-locking position against a force of the coil spring 24 owing to engagement with the worm gear 181. Thereafter, when electricity into the double-locking motor 18 stops, the sliding block 19 returns to the neutral position owing to force of the coil spring while the worm gear 181 is reversed. When the double-locking motor 18 turns toward the unlocking direction, the sliding block 19 moves up from the neutral position to the double-unlocking position 19B as shown by the broken line in FIG. 7 against the force of the coil spring 24 owing to engagement with the worm gear 181. Thereafter, when electricity into the double-locking motor stops, the sliding block 19 returns to the neutral position owing to the force of the coil spring 24 when the worm gear 181 is reversed.

A projection 202 at the upper end of a slide lever 20 is in sliding fit with an elongate opening 161 of the second key lever 16, and an elongate opening 203 at the lower end is in sliding fit with a projection of the sliding block 19. Thus, following the sliding block 19, the slide lever 20 moves to a double-unlocking position in FIGS. 3 to 6 and a double-locking position in FIG. 7 lower than the double-unlocking position.

When the sliding block 19 and the slide lever 20 are in the neutral position and in the double-unlocking position respectively, the projection 192 of the sliding block 19 is positioned at the lower end of the elongate opening 203 of the slide lever 20. When the sliding block 19 and the slide lever 20 are in the neutral position and the double-locking position, the projection 192 of the sliding block 19 is positioned at the upper end of the elongate opening 203 of the slide lever 20. Thus, when the slide lever 20 is in the double-unlocking position, the sliding block 19 moves from the neutral position to the double-locking position to allow the projection 192 to engage with the lower end of the elongate opening 203 enabling the slide lever 20 to move from the double-unlocking position to the double-locking position. Meanwhile, when the slide lever 20 is in the double-locking position, the sliding block 19 moves from the neutral position to the double-unlocking position to allow the projection 192 to engage with the upper end of the elongate opening 203 enabling the slide lever 20 to move from the double-locking position to the double unlocking position.

A spring 25 supported at the lower end of the cover 7 elastically engages with a projection 204 of the slide lever 20 to hold the slide lever 20 at a position.

Figure 3:
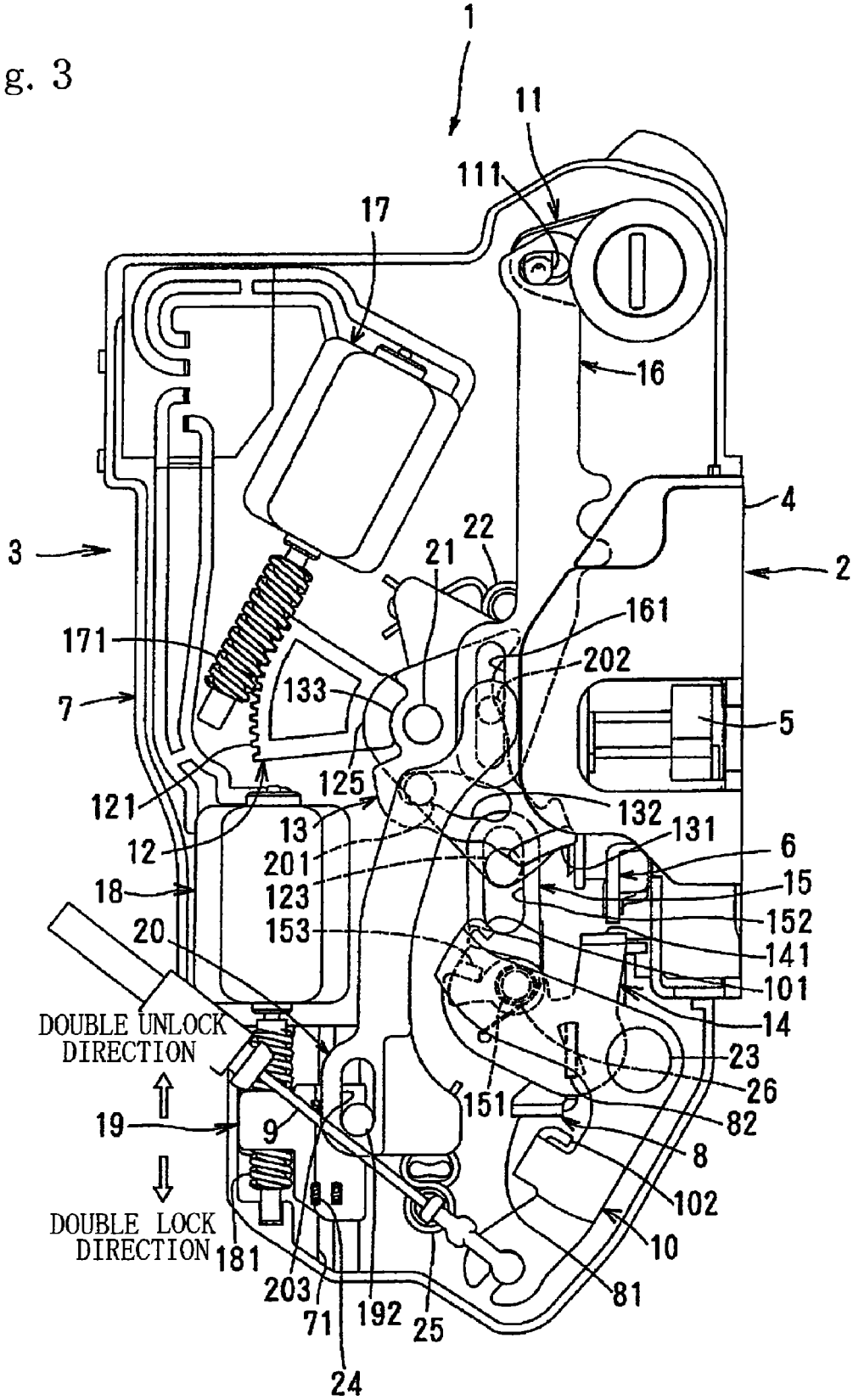
FIG. 3 is a front view of the unlocked door latch device.
Figure 5:
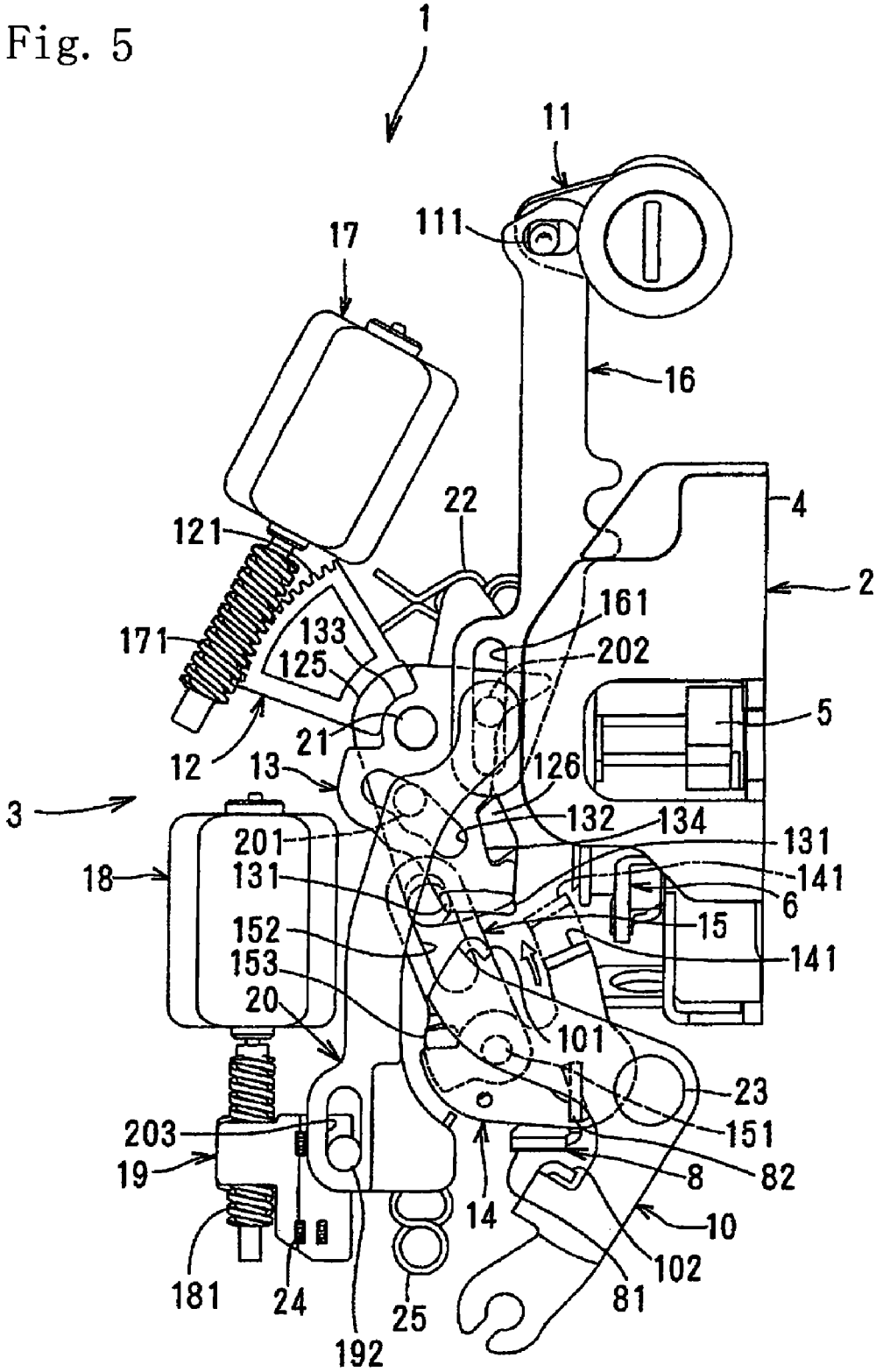
FIG. 5 is a front view of the locked door latch device.
Figure 7:
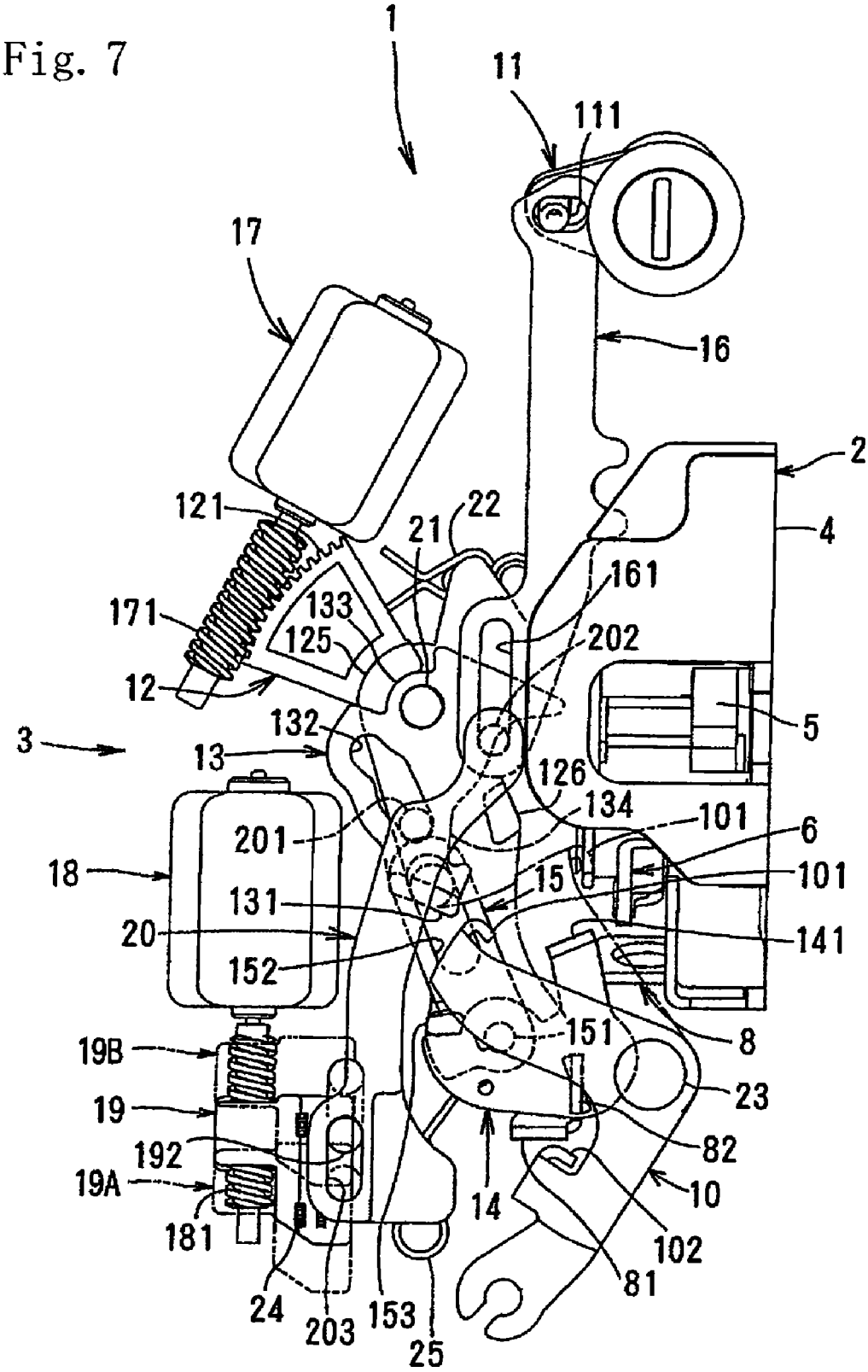
FIG. 7 is a front view of the double-locked door latch device.

In FIGS. 3 and 5, when the slide lever 20 is in the double-unlocking position and when the sliding block 19 and the second key lever 16 are in the neutral position, the upper projection 202 of the slide lever 20 is in the middle of the elongate opening 161 of the second key lever 16, and there is formed a play corresponding to stroke of the second key lever 16 between the projection 202 and the elongate opening 161. Thus, locking and unlocking of the second key lever 16 with the key cylinder is not transmitted to the slide lever 20. In FIG. 7, when the slide lever 20 and the sliding block 19 are in the double-locking position and in the neutral position, the projection 202 of the slide lever 20 is positioned at the lower end of the elongate opening 161 of the second key lever 16. Thus, unlocking of the second key lever 16 based on unlocking of the key cylinder is transmitted to the slide lever 20 by engaging the lower end of the elongate opening 161 with the projection 202 to enable the slide lever 20 to move from the double-locking position to the double-unlocking position. The operation by the slide lever 29 is not transmitted to the sliding block 19.

The locking lever 12 is pivotally mounted on a pivot shaft 21 to the cover 7 and can be rotated by the locking motor 17 and key cylinder to the unlocking position in FIGS. 3 and 4 and the locking position rotated from the unlocking position clockwise in FIG. 3 and counterclockwise in FIG. 4.

In the front of the locking lever 12, there are formed teeth 121 meshing with the worm gear 171 of the locking motor 17. At the rear part remote from the teeth 121, in FIGS. 4 and 6, there is formed a key-operation input portion 122 engaging with the projection 162 of the second key lever 16 with play corresponding to stroke of the key cylinder. At the end lower than the key-operation input portion 122 and remote from the teeth 121, there is formed an operation-transmitting portion 123 slidably connected to an elongate opening 152 of the second interconnecting lever 15. The teeth 121 mesh with the worm gear 171 reversibly.

As mentioned above, the locking lever 12 comprises the teeth 121 which rotate with the locking motor 17; the key-operation input portion 122 connected to the second key lever 16; and the operation transmitting portion 123 connected to the second interconnecting lever 15, thereby reducing the number of parts and simplifying the structure. Between the worm gear 171 and the second interconnecting lever 15, the meshing portion of the worm gear 171 with the teeth 121 and the engagement section of the operation transmitting portion 123 with the elongate opening 152 exist thereby simplifying the structure and transmitting the rotation of the locking motor 17 to the second interconnecting lever 15 more securely. The key-operation input portion 122 and operation transmitting portion 123 of the locking lever 12 are provided at the end remote from the teeth 121 with respect to the pivot shaft 21. Thus, force which exerts to the locking lever is dispersed to each end, stabilizing the support of the locking lever 12 and transmitting the rotation of the locking motor 17 to the second interconnecting lever 15 more securely. Furthermore, the key-operation input portion 122 is higher than the operation transmitting portion 123, so that the second key lever 16 does not overlap with the second interconnecting lever 15, making the operating section 3 thinner and connecting the second interconnecting lever 15 to the locking lever 12 more simply.

When the remote control switch is operated for locking or unlocking, the locking motor 7 rotates in the locking or unlocking direction. The rotation is transmitted to the locking lever 12 via the worm gear 171 and the teeth 121, so that the locking lever 12 rotates in the unlocking or locking position. When the key cylinder is operated for locking or unlocking, the second key lever 16 moves down or up via the first key lever 11, and the projection 162 of the second key lever 16 gets in touch with the lower or upper edge of the key-operation input portion 122 of the locking lever 12 to enable the locking lever 12 to turn to the locking or unlocking position. When the locking lever 12 is in the unlocking or locking position, the upper projection 124 elastically gets in touch with the spring 22 on the cover 7, so that the locking lever 12 is elastically held in the unlocking or locking position.

Figure 6:
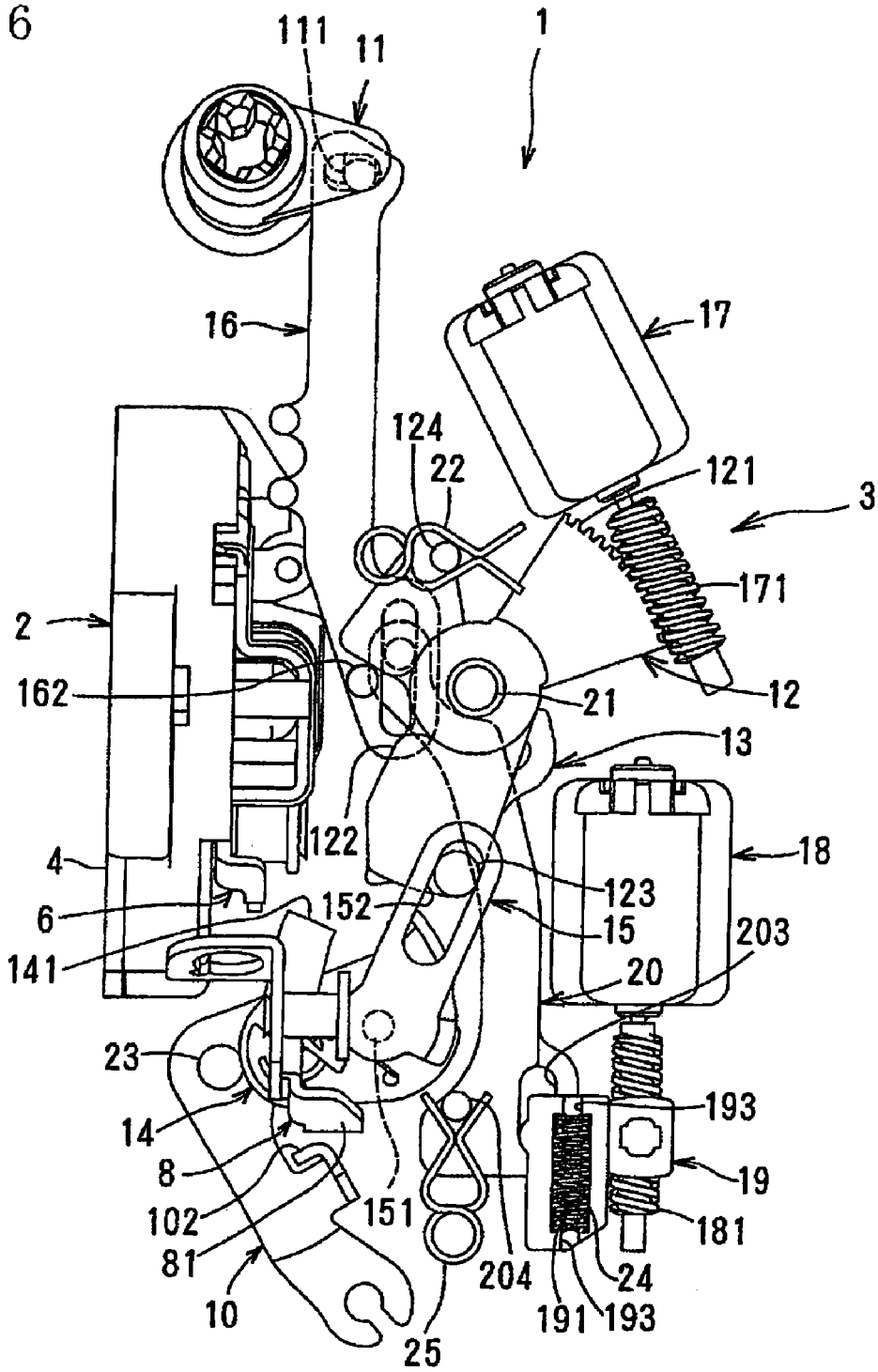
FIG. 6 is a rear view of the locked door latch device.

The subsidiary locking lever 13 is pivotally mounted on the pivot shaft 21 to rotate separately from the locking lever 12 among the unlocking position in FIGS. 3 and 4; the unlocking position in FIGS. 5 and 6 rotating clockwise in FIG. 3 or counterclockwise in FIG. 4; and the double-locking position in FIG. 7 rotating from the locking position clockwise in FIG. 5 and counterclockwise in FIG. 6.

On the subsidiary locking lever 13, there is formed an arcuate cutaway portion 133 engagable with the projection 125 of the locking lever 12 and a recess 134 engagable with the projection 126 of the locking lever 12. The subsidiary locking lever 13 comprises a contact portion 131 which can get in touch with a contact portion 101 (later described) of the inner lever 10, and an elongate opening 132 which is in sliding fit with a projection 201 at the upper part of the sliding lever 20.

When the locking lever 12 moves from the unlocking position to the locking position with the locking motor 17 or key cylinder, the projection 126 engages in the recess 134 of the subsidiary locking lever 13. The subsidiary locking lever 13 follows the locking lever 12 and turns from the unlocking position to the locking position. When the locking lever 12 moves from the locking position to the unlocking position, the projection 125 engages with the lower end of the recess 133, so that the subsidiary locking lever 13 follows the locking lever to turn from the locking position to the unlocking position.

The elongate opening 132 of the subsidiary locking lever 13 is arcuate around the pivot shaft in the left half in FIG. 3, and is straight in the right half. When the subsidiary locking lever 13 is in the unlocking position, the elongate opening 132 is almost horizontal, while it is tilted along sliding of the sliding lever 20 or vertically in the locking position or double-locking position.

The projection 201 of the sliding lever 20 is positioned at the front end of the elongate opening 132 when the subsidiary locking lever 13 is in the unlocking position, positioned in the middle of the opening 132 when the lever 13 is in the locking position, and positioned at the rear end of the opening 132 when the lever 13 is in the double-locking position. Thus, when the subsidiary locking lever 13 turns between the unlocking and locking positions, the projection 201 moves along the arcuate portion of the elongate opening 132, so that the subsidiary locking lever 13 freely turns between the unlocking and locking positions. When the subsidiary locking lever 13 is in the locking or double-locking position, the sliding lever 20 moves straight vertically with the double-locking motor 18, and the linear motion can be converted into rotational motion with the projection 201 and the elongate opening 132.

When the sliding lever 20 moves from the double-unlocking position to the double-locking position, the projection 201 of the sliding lever 20 contacts the upper edge of the elongate opening 132 of the subsidiary locking lever 13, so that the subsidiary locking lever 13 follows the sliding lever 20 and turns from the locking position to the double-locking position. Between the projection 125 of the locking lever 12 and the recess 133 of the subsidiary locking lever 13, there is formed a play corresponding to stroke between the locking and double-locking positions of the subsidiary locking lever 13, so that motion in which the subsidiary locking lever 13 shifts from the locking position to the double-locking position is not transmitted to the locking lever 12. When the subsidiary locking lever 13 moves from the double-locking position to the double-unlocking position, the projection 201 of the slide lever 20 contacts the lower edge of the elongate opening 132, so that the subsidiary locking lever 13 follows the slide lever 20 and turns from the double-locking position to the locking position. Between the projection 125 of the locking lever 12 and the recess 133 of the subsidiary locking lever 13, there is formed a play corresponding to stroke of the subsidiary locking lever 13 between the double-locking position and the locking position, so that motion in which the subsidiary locking lever 13 shifts from the double-locking position to the locking positions is not transmitted to the locking lever 12.

The contact portion 131 of the subsidiary locking lever 13 faces the contact portion 101 of the inner lever 10 when the subsidiary locking lever 13 is in the locking position, and it goes out of the track of the contact portion 101 when it is in the double-locking position.

The first interconnecting lever 14 is coupled at the lower end to the end 82 of the outer lever 8 to swing back and forth, and comprises the contact portion 141 which contacts the opening lever 6.

Figure 12:
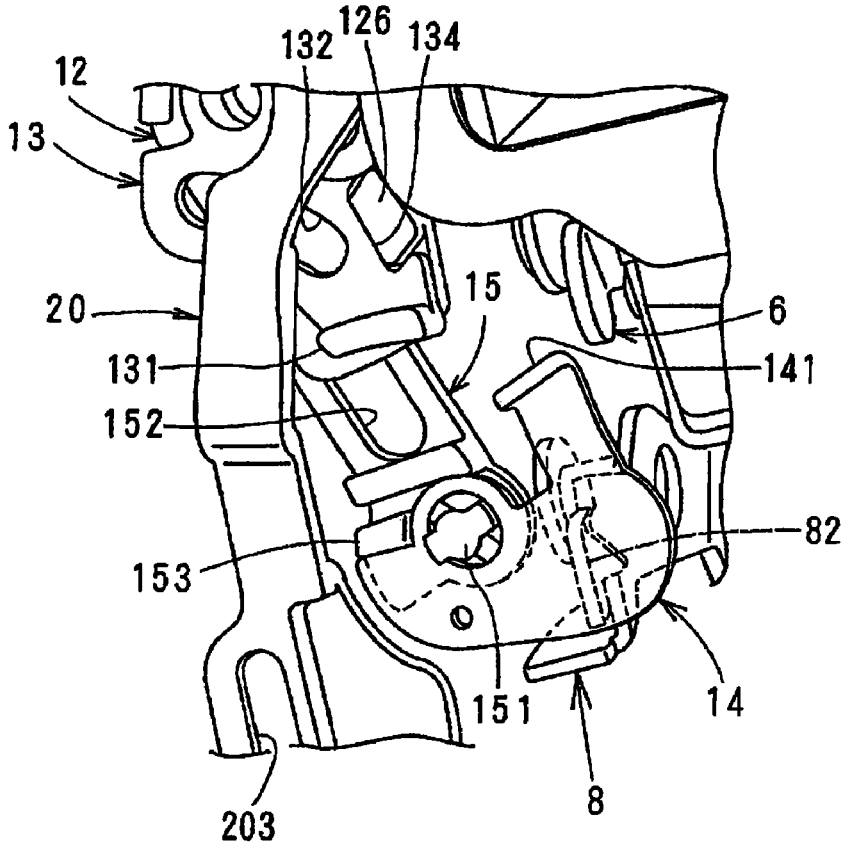
FIG. 12 is a perspective view for illustrating the first and second interconnecting levers.

The second interconnecting lever 15 is coupled to the first part of the first interconnecting lever 14 with a connecting shaft 151 so that the second interconnecting lever 15 can swing. There is provided an engagement section 153 which can engage counterclockwise with respect to the first interconnecting lever 14 in FIG. 12. On the connecting shaft 151, a spring 26 in FIGS. 3 and 4 which is engaged with the first interconnecting lever 14 at one end and with the second interconnecting lever 15 at the other end is wound. For simplification of the drawings, the spring 26 is shown only in FIGS. 3 and 4, and omitted in the other views.

The spring 26 exerts into between the first interconnecting lever 14 and the second interconnecting lever 15 and apply a force in a direction in which the first interconnecting lever 14 gets in touch with the engagement section 153 of the second interconnecting lever 15. Thus, the first and second interconnecting levers 14,15 work together within a holding force of the spring 26.

The first and second interconnecting levers 14,15 make the operating section of the locking lever 12 and the second interconnecting lever 15 to follow the locking lever 12 via the elongate opening 152. The first and second interconnecting levers 14,15 are rotatable between the locking position in FIGS. 3 and 4 and the unlocking position in FIGS. 5 and 6 and move upward, following releasing of the outer lever 8.

The release contact portion 141 of the first interconnecting lever 14 faces the opening lever 6 when the first interconnecting lever 14 is in the unlocking position, and moves to a position in which it does not face the opening lever 6.

When the first and second interconnecting levers 14,15 are in the unlocking position, they move upward by releasing of the outer lever 8. The release contact portion 141 of the first interconnecting lever 14 contacts the opening lever 6 to make it possible for the opening lever 6 to turn in the release direction. Thus, the door can be opened. When the first and second interconnecting levers 14,15 are in the locking position, the first and second interconnecting levers 14,15 move upward owing to rotation of the outer lever 8 in the releasing direction, the door cannot be opened since the release contact portion 141 cannot contact the opening lever 6.

Figure 8:
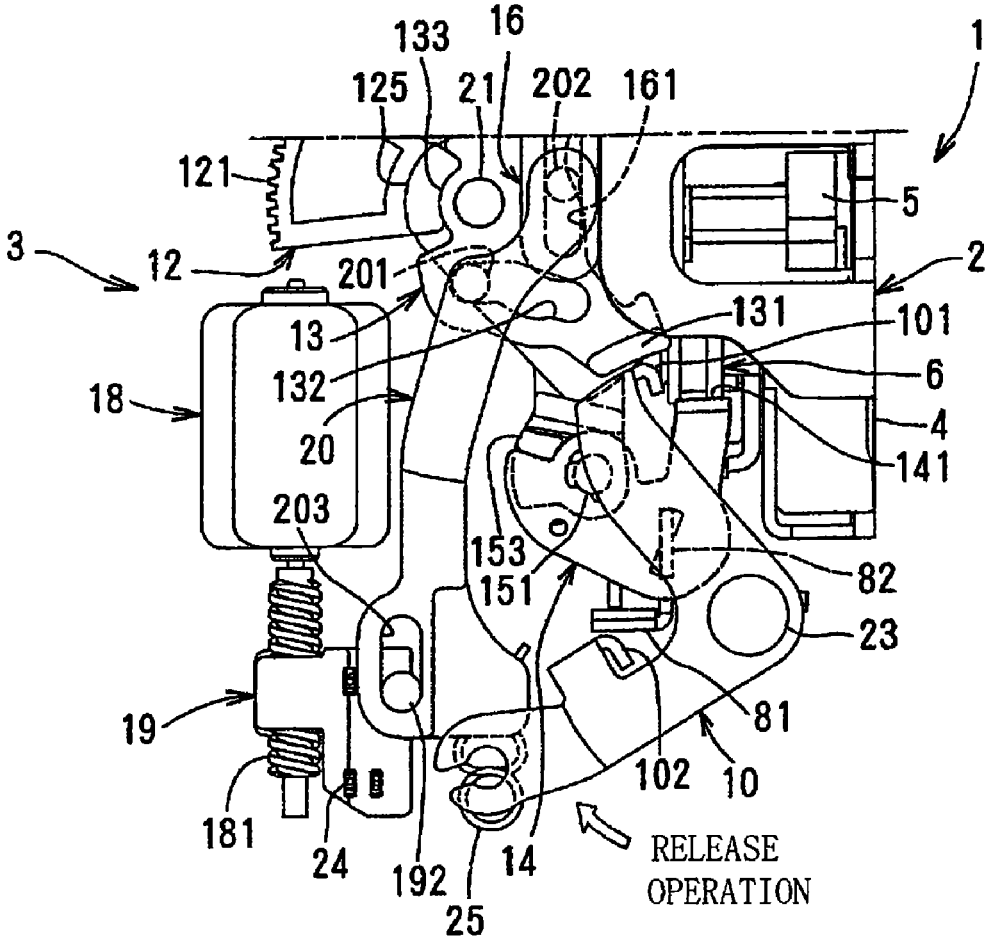
FIG. 8 is a front view of the door latch device when an inner handle is operated.

The inner lever 10 is pivotally mounted to the lower part of the cover 7 with the pivot shaft 23. At the upper part, the unlocking contact portion 101 which can contact the locking contact portion 131 of the subsidiary locking lever 13 is provided. At the front part, the contact portion 102 which can contact the end 81 of the outer lever 8 is provided and turns in a releasing direction or clockwise from the standby position in FIGS. 3 and 5 to the release position in FIG. 8.

When the inner lever 10 turns in the release direction, the contact portion 102 contacts the end 81 of the outer lever 108 thereby turning the outer lever 8 in the release direction. When the locking lever 12 and the subsidiary locking lever 13 are in the locking position, the subsidiary locking lever 13 is moved in the unlocking position, thereby moving the locking lever 12, and the first and second interconnecting levers 14,15 to the unlocking position.

Embodiments of the present invention will be described.

When the Outer or Inner Handle is Operated in the Locking Condition

In FIGS. 3 and 4, when the door latch device 1 is in the unlocking condition, the locking lever 12, the subsidiary locking lever 13 and the first and second interconnecting levers 14,15 are in the unlocking condition respectively, and the release contact portion 141 of the first interconnecting lever 14 is in a position facing the opening lever 6. According to door-opening operation of the outer handle in this state, the first and second interconnecting levers 14,15 move upward in FIG. 8, the release contact portion 141 contacts the opening lever 6. Thus, the opening lever 6 rotates in the release direction, and the ratchet leaves the latch 5, so that the door can be opened. When the inner lever 10 rotates in the release direction based on door-opening operation, the contact portion 102 of the inner lever 10 contacts the end 81 of the outer lever 8 to allow the outer lever 8 to rotate in the release direction, so that the door can be opened by a similar way to the outer handle.

When the Locking Motor 17 is Rotated in the Locking Direction in the Locking State Rotation of the locking motor 17 in the locking direction is transmitted to the locking lever 12 via the worm gear 171 and the teeth 121. The locking lever 12 is rotated around the pivot shaft 21 from the unlocking position in FIGS. 3 and 4 to the locking position in FIGS. 5 and 6. The subsidiary locking lever 13 moves from the unlocking position to the locking position by engagement of the projection 126 into the recess 134. At the same time, motion of the locking lever 12 is transmitted to the second interconnecting lever 15 via the operation transmitting portion 123 and the elongate opening 152, and the first and second interconnecting levers 14,15 move to the locking position.

From the above, in this embodiment, the locking lever 12 is integrally formed with the teeth 121 directly engaging with the worm gear 171 of the locking motor 17 and the operation transmitting portion 123 directly joined to the second interconnecting lever 15, thereby enabling rotation of the worm gear 171 to be transmitted to the second interconnecting lever 15 securely via the locking lever 12. Between the worm gear 171 and the second interconnecting lever 15, the operation transmitting portion 123 and the elongate opening 152 only exist, thereby reducing the number of connection and simplifying the structure.

When the Outer Handle or the Inner Handle is Operated in the Locked State

In FIGS. 5 and 6, when the door latch device 1 is locked, the locking lever 12, the subsidiary locking lever 13 and the first and second interconnecting levers 14,15 are a locked position respectively, the release contact portion 141 of the first interconnecting lever 14 is in a position which is not capable of contacting the opening lever 6, and the contact portion 131 of the subsidiary locking lever 13 is in a position facing the release contact portion 101 of the inner lever 10.

In FIGS. 5 and 6, when the door latch device 1 is locked, the locking lever 12, the subsidiary locking lever 13 and the first and second interconnecting levers 14,15 are in the locking position; the release contact portion 141 of the first interconnecting lever 14 is in a position which is not capable of locking; and the contact portion 131 of the subsidiary locking lever 13 is in a position facing the release contact portion 101 of the inner lever 10.

When the outer handle is operated to open the door, the door cannot be opened since the release contact portion 141 of the first interconnecting lever 14 does not contact the opening lever 6 even if the release contact portion 141 of the first interconnecting lever 14 moves to a position as shown by a two dotted line in a direction of an arrow in FIG. 5. The door cannot be opened by door-opening operation of the outer handle.

When the inner handle is operated in the double action, the locking lever 12, the subsidiary locking lever 13 and the first and second interconnecting levers 14,15 are moved from the locking position to the unlocking position, and the door can be opened by the second door-opening operation of the inner handle.

Figure 10:
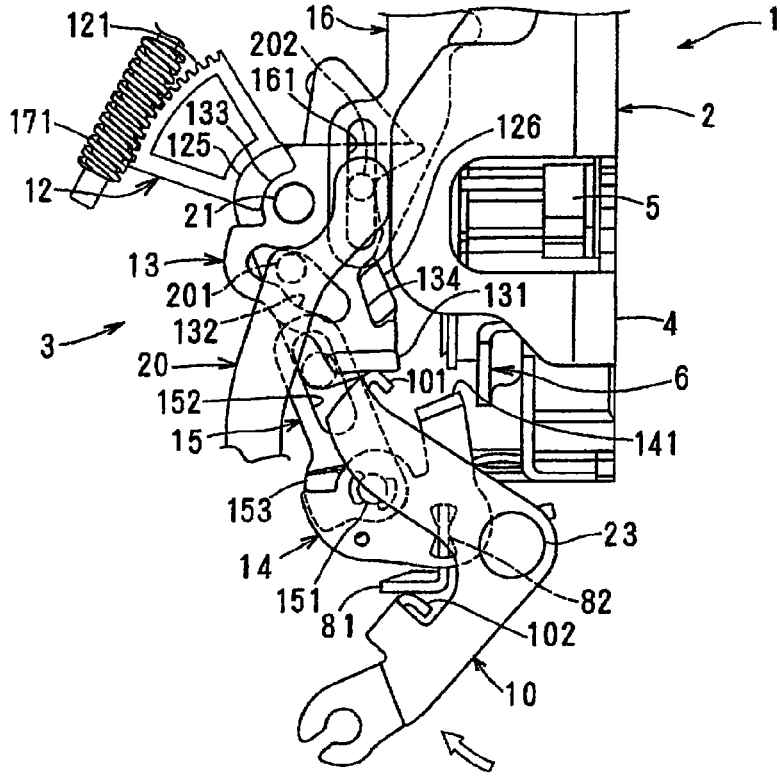
FIG. 10 is a front view of the door latch device in initial period of double action.

In the first door-opening operation of the inner handle, the inner lever 10 rotates in the release direction, and the contact portion 102 of the inner lever 10 contacts the end 81 of the outer lever 8. While the outer lever 8 rotates in the release direction, the unlocking contact portion 101 gets in touch with the unlocked contact portion 131 of the subsidiary locking lever 13. Thus, as shown in FIG. 10, the first and second interconnecting levers 14,15 move upward owing to rotation of the outer lever 8 in the release direction and move in the release direction with motion of the subsidiary locking lever 13 and the locking lever 12 to the unlocking position.

Figure 11:
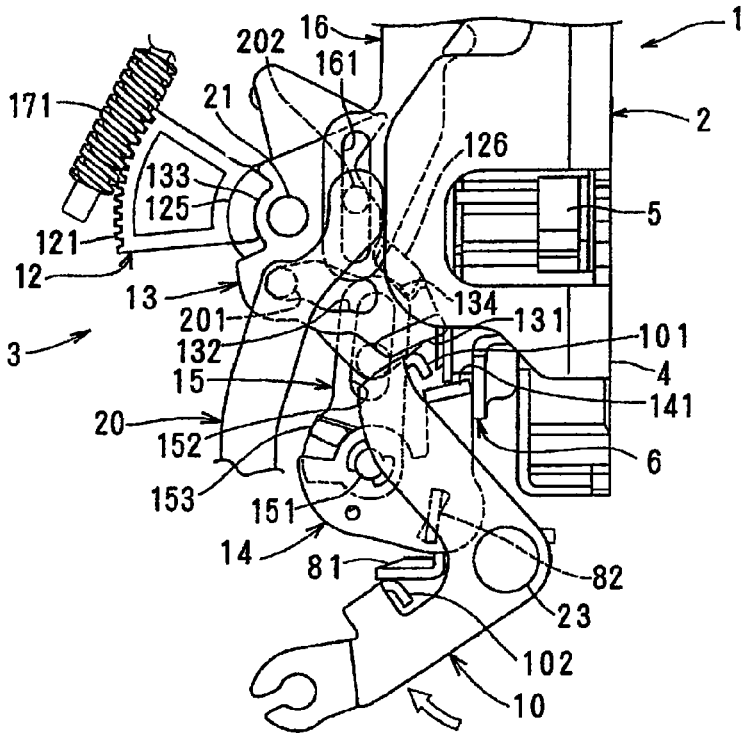
FIG. 11 is a front view of the door latch device in latter period of double action.

In FIG. 11, when the inner lever 10 rotates to the release position, the subsidiary locking lever 13, the locking lever 12 and the second interconnecting lever 15 move to the unlocking position. At the same time, the first interconnecting lever 14 moves upward and contacts the side of the opening lever 6, so that the first interconnecting lever 14 stops in front of the unlocking position. Then, with the inner handle, the inner lever 10 and the outer lever 8 are returned to the standby position. The first interconnecting lever 14 moves downward and leaves the side of the opening lever 6. Thus, the first interconnecting lever 14 moves to the unlocking position in FIGS. 3 and 4 by force of the spring 26. Then, with the inner handle, the door can be opened with similar action to the unlocked door latch device 1.

When the Double-Locking Motor 18 Rotates in the Double-Locking Direction

With a portable remote control switch, the double locking motor 18 is rotated in a double-locking direction. The rotation is transmitted to the subsidiary locking lever 13 via the worm gear 181, the sliding block 19 and the slide lever 20. The subsidiary locking lever 13 moves from the locking position in FIGS. 5 and 6 to the double-locking position in FIG. 7, so that the unlocked contact portion 131 goes out of the track of the locked contact portion 101. Between the subsidiary locking lever 13 and the locking lever 12, there is formed a play corresponding to a distance between the locking position and the double-locking position of the subsidiary locking lever 13. Even if the subsidiary locking lever 13 moves from the locking position to the double-locking position, the locking lever 12 still remains. The double-locking motor 18 stops almost at the same time that the subsidiary locking lever 13 moves to the double-locking position, and the sliding block 19 returns to the neutral position by force of the coil spring 24.

When the Outer Handle or the Inner Handle are Operated in the Double-Locking Condition Even if the outer lever 8 is rotated in the release direction with the outer handle outside the vehicle, the locking lever 13 and the first and second interconnecting levers 14,15 are in the locking position, and the release contact portion 141 of the first interconnecting lever 141 cannot contact the opening lever 6, so that the door cannot be opened.

Even if the outer lever 8 is rotated in the release direction by rotating the inner lever 10 in the release direction with the inner handle inside the vehicle, the door cannot be opened as is operated by the outer handle. The unlocked contact portion 131 of the subsidiary locking lever 13 is out of the unlocking contact portion 101 of the inner lever 10, so that it is not possible to move the subsidiary locking lever 13, the locking lever 12, and the first and second interconnecting levers 14,15 to unlocking position since the unlocked contact portion 131 of the subsidiary locking lever 13 is out of the track of the unlocking contact portion 101 of the inner lever. The double-locking state invalidates not only door-opening operation of the outer handle and the inner handle but also double action of the inner handle. Even if the inner handle is operated by unfair action, the door cannot be opened.

When the Double-Locking Motor 18 is Rotated in the Unlocking Direction in the Double Locking Owing to unlocking operation of the remote control switch, the double-locking motor 18 is rotated in the release direction, and its rotation is transmitted to the sliding block 19 via the worm gear 181. The sliding block 19 moves from a neutral position shown by solid lines to the double-unlocking position 19B against a force of the spring 24, and moves the slide lever 20 from the double locking position to the double unlocking position via the projection 192 and the elongate opening 203. When the slide lever 20 moves to the double-unlocking position, the double-locking motor 18 stops and the sliding block 19 returns to the neutral position by the force of the coil spring 24.

Movement of the slide lever 20 to the double unlocking position is transmitted to the subsidiary locking lever 13 via the projection 201 and the elongate opening 132. The subsidiary locking lever 13 rotates from the double-locking position to the locked position. The double locking is released and the locked state is obtained.

When the Key Cylinder is Unlocked in the Double-Locking Condition

Figure 9:
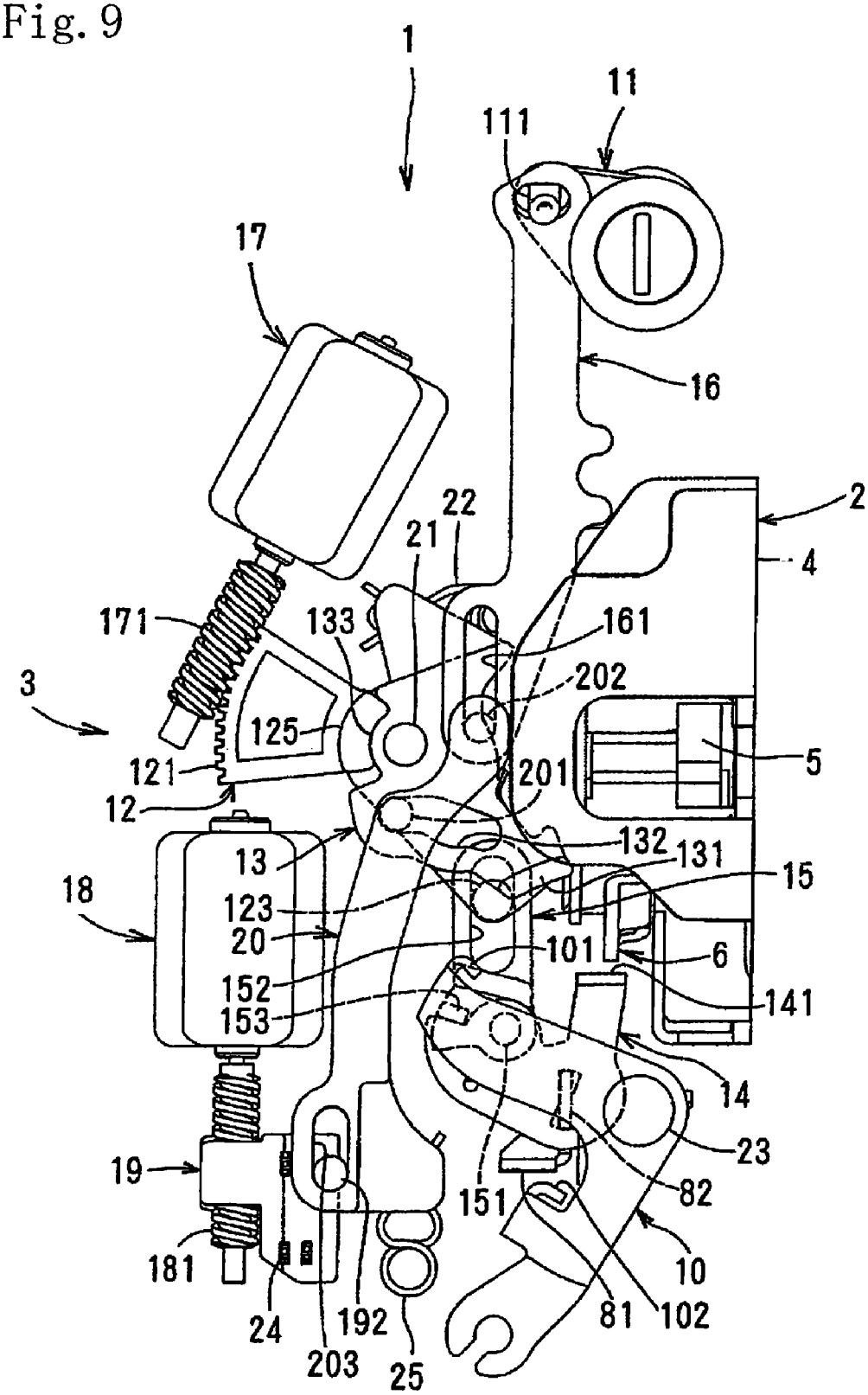
FIG. 9 is a front view of the door latch device when a key cylinder is operated to unlock the latch.

When the key cylinder is unlocked from the outside of the vehicle, the second key lever 16 moves upward from the neutral position in FIG. 7 to the unlocked position in FIG. 9 via the first key lever 11. Movement of the second key lever 16 is transmitted to the slide lever 20 via the elongate opening 161 and the projection 202 and to the locking lever 12 by contact of the projection 162 with the key-operation input portion 122 of the locking lever 12. Thus, the slide lever 20 moves from the locking position to the unlocking position to allow the first and second interconnecting levers 14,15 to move from the locking position to the unlocking position.

From the above, in the double locking state, even if the locking motor 17 and the double-locking motor 18 cannot be driven, the key cylinder is operated manually to make the double locking state released to the unlocking state, so that the door can be opened by door-opening operation of the outside handle.

Embodiments of the present invention are described, but the following modifications and changes can be made without departing from the scope of claims.

(i) The first key lever 11 is integrally formed with the second key lever 16.

(ii) The key operation input portion 122 of the locking lever 12 inputted by the second key lever 16 may be an elongate opening in which the projection 162 of the second key lever 16 slidably fits. An elongate opening may be instead of the projection 162 of the second key lever 16, and the key-operation input portion 122 may be a projection which slidably fits in the opening.

(iii) In FIG. 7, instead of the subsidiary locking lever 13 in the foregoing embodiment, the unlocked contact portion 131 of the subsidiary locking lever 13 may be formed together with and close to the operation transmitting portion 123 of the locking lever 12. The door latch device 1 in this case comprises similar structure to the above embodiment except not having double locking function by abolishing the double-locking motor 18, the sliding block 19 and the slide lever 20. The same numerals are allotted to the same parts in the foregoing embodiment, and its description is omitted.

(iv) By a single door-opening operation of the inner handle, the locking lever 12, the subsidiary locking lever 13 and the first and second interconnecting levers 14,15 are moved from the locking position to the unlocking position with release of the door latch device 1 which is called "one-motion". In this case, the unlocking contact portion 101 of the inner lever 10 contacts the unlocked contact portion 131 to allow the subsidiary locking lever 13 to move to the unlocking position. Thereafter, the unlocking contact portion 141 of the first interconnecting lever 14 makes the opening lever 6 rotate in the unlocking direction.

What is claimed is:

1. A door latch device for a motor vehicle, comprising:

an engagement section that engages with a striker of a vehicle body and has an opening lever for disengaging an engagement portion from the striker;

a key lever operated with a key cylinder provided on an outside of the vehicle body;

a locking lever moving between an unlocking position for validating operation of a handle to open a door and a locking position for invalidating the operation, the locking lever comprising a single lever pivotally mounted on a pivot shaft, the locking lever having teeth, a key-operation input portion coupled to the key lever and an operation transmitting portion;

an interconnecting lever that can actuate the opening lever with the handle to disengage the engagement section from the striker, the interconnecting lever making it impossible to actuate the opening lever even with the handle to disengage the engagement section from the striker when the locking lever is in the locking position, the interconnecting lever comprising an elongate opening; and a motor having teeth on a rotational shaft, the teeth of the motor meshing with the teeth of the locking lever to move the locking lever to the unlocking position and the locking position, the operation transmitting portion of the locking lever engaging with the elongate opening of the interconnecting lever to allow rotation of the motor to be transmitted to the interconnecting lever via the locking lever.

2. The door latch device of claim 1 wherein the operation transmitting portion of the locking lever is provided at an end opposite the teeth of the locking lever with respect to the pivot shaft.

3. The door latch device of claim 2 wherein the key operation input portion of the locking lever is provided at an end opposite the teeth of the locking lever with respect to the pivot shaft higher than the operation transmitting portion.

4. The door latch device of claim 1, further comprising an inner lever connected to the handle via a cable and operated for unlatching with the handle, the locking lever comprising an unlocked contact portion that can contact the inner lever.

* * * * *